US007400092B2

(12) United States Patent
Park et al.

(10) Patent No.: US 7,400,092 B2
(45) Date of Patent: Jul. 15, 2008

(54) PLASMA DISPLAY HAVING BARRIER RIBS THAT EACH OVERLAP THE BUS ELECTRODES OF DIFFERENT ELECTRODES ONLY IN PART

(75) Inventors: Kirack Park, Gyeongsangbuk-do (KR); Seonghwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/276,697

(22) Filed: Mar. 10, 2006

(65) Prior Publication Data

US 2007/0120484 A1 May 31, 2007

(30) Foreign Application Priority Data

Nov. 25, 2005 (KR) ..... 10-2005-0113831

(51) Int. Cl.
*H01J 17/49* (2006.01)

(52) U.S. Cl. ..... 313/582; 313/585; 345/60

(58) Field of Classification Search ..... 313/582–587; 345/60; 315/169.4

See application file for complete search history.

(56) References Cited

U.S. PATENT DOCUMENTS

2001/0019318 A1* 9/2001 Sano et al. ..... 345/60
2004/0239249 A1* 12/2004 Kang ..... 313/586
2005/0104807 A1* 5/2005 Tachibana et al. ..... 345/60
2005/0151476 A1* 7/2005 Tachibana et al. ..... 313/585
2006/0012303 A1* 1/2006 Ishibashi et al. ..... 313/582

FOREIGN PATENT DOCUMENTS

JP 06-130913 5/1994

* cited by examiner

*Primary Examiner*—Karabi Guharay
(74) *Attorney, Agent, or Firm*—Fish & Richardson P.C.

(57) ABSTRACT

Provided is a plasma display panel comprising first and second electrodes, a first barrier rib, and a second barrier rib. The first and second electrodes are formed on an upper substrate. The first barrier rib is formed over a lower substrate to be disposed under the first electrode. The second barrier rib is formed over the lower substrate to be disposed under the second electrode. A barrier rib center point between the first and second barrier ribs is different from an electrode center point between the first and second electrodes.

20 Claims, 6 Drawing Sheets

PLASMA DISPLAY HAVING BARRIER RIBS THAT EACH OVERLAP THE BUS ELECTRODES OF DIFFERENT ELECTRODES ONLY IN PART

This application claims the benefit of Korean Patent Application No. 10-2005-0113831, filed on Nov. 25 , 2005, which is hereby incorporated by reference for all purposes as if fully set forth herein.

BACKGROUND OF THE INVENTION

1. Field of the Invention

The present invention relates to a plasma display panel, and more particularly, to a plasma display panel in which a scan electrode and/or a sustain electrode overlaps with a barrier rib.

2. Description of the Background Art

In general, in a plasma display panel, a barrier rib formed between a front panel and a rear panel forms one discharge cell. Main discharge gas such as neon (Ne), helium (He) or a mixture (He+Ne) of neon and helium and inert gas containing a small amount of xenon (Xe) are filled in each discharge cell. Such a discharge cell is collected in plural, thereby forming one pixel. For example, a red discharge cell, a green discharge cell, and a blue discharge cell are collected and form one pixel.

In such a plasma display panel, when discharge is performed using high frequency voltage, the inert gas generates vacuum ultraviolet rays and excites phosphors provided between the barrier ribs, thereby embodying an image. The plasma display panel is attracting attention as a next generation display apparatus due to its slimness and lightweigtness.

As described above, in the plasma display panel, the discharge is generated in the discharge cell, thereby displaying the image. For example, reset discharge, address discharge, and sustain discharge are generated. The address discharge is discharge for selecting a discharge cell generating the sustain discharge, which is main discharge for displaying the image, from the plurality of discharge cells.

Meantime, the conventional plasma display panel has a drawback of weakly generating the address discharge for selecting the discharge cell generating the sustain discharge.

Accordingly, in the conventional plasma display panel, there is a drawback in that, since the sustain discharge is not generated in the discharge cell in which the sustain discharge should be generated, the image is deteriorated in screen quality or is not even embodied.

SUMMARY OF THE INVENTION

Accordingly, an object of the present invention is to solve at least the problems and disadvantages of the background art.

An object of the present invention is to provide a plasma display panel for improving a scan electrode, a sustain electrode, and a barrier rib, thereby stabilizing address discharge.

In another aspect of the present invention, there is provided a plasma display panel comprises first and second electrodes, a first barrier rib, and a second barrier rib. The first and second electrodes are formed on an upper substrate. The first barrier rib is formed over a lower substrate to be disposed under the first electrode. The second barrier rib is formed over the lower substrate to be disposed under the second electrode. A barrier rib center point between the first and second barrier ribs is different from an electrode center point between the first and second electrodes.

In another aspect of the present invention, there is provided a plasma display panel comprising first and second electrodes, a first barrier rib, and a second barrier rib. The first and second electrodes are formed over an upper substrate. The first barrier rib is formed over a lower substrate to be disposed under the first electrode, and comprises first and second scan barrier ribs forming discharge cells different from each other. The second barrier rib is formed over the lower substrate to be disposed under the second electrode, and comprises first and second sustain barrier ribs forming discharge cells different from each other. A barrier rib center point between the first and second barrier ribs is different from an electrode center point between the first and second electrodes.

In a further aspect of the present invention, there is provided a plasma display panel comprising first and second electrodes, a first barrier rib, a second barrier rib, and a discharge cell. The first and second electrodes are formed on an upper substrate. The first barrier rib is formed over a lower substrate to be disposed under the first electrode. The second barrier rib is formed over the lower substrate to be disposed under the second electrode. The discharge cell is defined between the first and second barrier ribs. An overlap area of the discharge cell and the first electrode is different in size from an overlap area of the discharge cell and the second electrode.

In the present invention, there is effect in that the area of the sustain electrode and the barrier rib gets greater than the area of the scan electrode and the barrier rib, thereby getting an area of the scan electrode greater than an area of the sustain electrode within one discharge cell and more stabilizing the address discharge.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Figure 1:
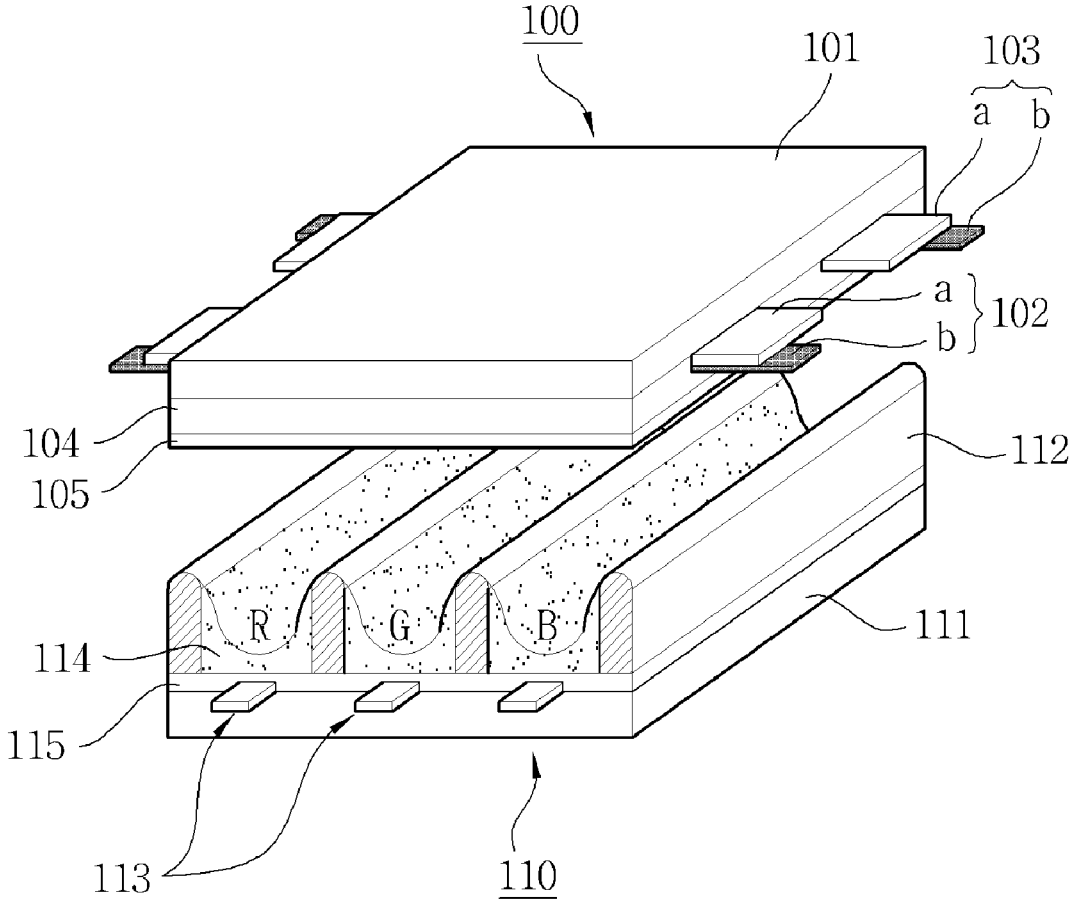
FIG. 1 illustrates a structure of a plasma display panel according to the present invention.

Reference will now be made in detail to embodiments of the present invention, examples of which are illustrated in the accompanying drawings.

In another aspect of the present invention, there is provided a plasma display panel comprises: first and second electrodes formed on an upper substrate; a first barrier rib formed over a lower substrate to be disposed under the first electrode; and a second barrier rib formed over the lower substrate to be disposed under the second electrode, wherein a barrier rib center point between the first and second barrier ribs is different from an electrode center point between the first and second electrodes.

The barrier rib center point is a point corresponding to half of an average distance between the first and second barrier ribs.

The electrode center point is a point corresponding to half of a distance between the first and second electrodes.

Within a discharge cell, an overlap area of the first barrier rib and the first electrode is smaller in size than an overlap area of the second barrier rib and the second electrode.

The first electrode has almost the same width as the second electrode.

The first barrier rib is comprised of first and second scan barrier ribs forming discharge cells different from each other.

The second barrier rib is comprised of first and second sustain barrier ribs forming discharge cells different from each other.

A scan channel is provided between the first and second scan barrier ribs.

A sustain channel is provided between the first and second sustain barrier ribs.

The scan channel comprises the same one black layer.

The first and second electrodes are bus electrodes.

In another aspect of the present invention, there is provided a plasma display panel comprising: first and second electrodes formed on an upper substrate; a first barrier rib formed over a lower substrate to be disposed under the first electrode, and comprising first and second scan barrier ribs forming discharge cells different from each other; and a second barrier rib formed over the lower substrate to be disposed under the second electrode, and comprising first and second sustain barrier ribs forming discharge cells different from each other, wherein a barrier rib center point between the first and second barrier ribs is different from an electrode center point between the first and second electrodes.

The barrier rib center point is a point corresponding to half of an average distance between the first and second barrier ribs.

The electrode center point is a point corresponding to half of a distance between the first and second electrodes.

The first electrode has almost the same width as the second electrode.

A scan channel is provided between the first and second scan barrier ribs.

A sustain channel is provided between the first and second sustain barrier ribs.

The scan channel comprises the same one black layer.

The sustain channel comprises the same one black layer.

In a further aspect of the present invention, there is provided a plasma display panel comprising: first and second electrodes formed on an upper substrate; a first barrier rib formed over a lower substrate to be disposed under the first electrode; a second barrier rib formed over the lower substrate to be disposed under the second electrode; and a discharge cell defined between the first and second barrier ribs, wherein an overlap area of the discharge cell and the first electrode is different in size from an overlap area of the discharge cell and the second electrode.

Hereinafter, exemplary embodiments of the present invention will be described in detail with reference to the attached drawings.

FIG. 1 illustrates a structure of a plasma display panel according to the present invention.

Referring to FIG. 1, the inventive plasma display panel comprises a front panel 100 and a rear panel 110. The front panel 100 has a scan electrode 102 (Y) and a sustain electrode 103 (Z) formed on a front substrate 101, which is a display surface for displaying an image thereon. The rear panel 110 has a plurality of address electrodes 113 arranged to intersect with the scan electrode 102 (Y) and the sustain electrode 103 (Z) on a rear substrate 111, which is a rear surface. The rear panel 110 is spaced apart in parallel with and is sealed to the front panel 100.

The front panel 100 comprises the scan electrode 102 (Y) and the sustain electrode 103 (Z) for performing mutual discharge in one pixel and sustaining emission of light from one discharge space, that is, from a discharge cell. In other words, the front panel 100 comprises the scan electrode 102 (Y) and the sustain electrode 103 (Z) each comprising a transparent electrode (a) formed of indium-tin-oxide (ITO) and a bus electrode (b) formed of metal. The scan electrode 102 (Y) and the sustain electrode 103 (Z) are covered with at least one upper dielectric layer 104, which limits a discharge electric current and insulates an electrode pair. A protective layer 105 is deposited using predetermined protective material, for example, oxide magnesium (MgO), on the upper dielectric layer 104 to facilitate a discharge condition.

The rear panel 110 comprises stripe-type (or well-type) barrier ribs 112 for forming a plurality of discharge spaces (that is, discharge cells). Also, the rear panel 110 comprises a plurality of address electrodes 113 (X) arranged in parallel with the barrier ribs 112, and performing address discharge and generating vacuum ultraviolet rays. Phosphors 114, for example, red (R), green (G), and blue (B) phosphors emit visible rays for displaying the image in the address discharge, and are coated on an upper surface of the rear panel 110. A lower dielectric layer 115 for protecting the address electrode 113 (X) is formed between the address electrode 113 (X) and the phosphor 114.

FIG. 1 illustrates only one example of the plasma display panel according to the present invention. It should be noted that the present invention is not limited to the structure of the plasma display panel of FIG. 1. For example, FIG. 1 illustrates only a case where the upper dielectric layer 104 is comprised of one layer, but the upper dielectric layer 104 can be also comprised of a plurality of layers.

Considering FIG. 1, in the plasma display panel according to the present invention, the scan electrode 102 (Y) and the sustain electrode 103 (Z) supplying a driving voltage are formed on the front substrate 101, and the address electrode 113 (X) is formed on the rear substrate 111, and the barrier rib 112 is formed between the front substrate 101 and the rear substrate 111. Other conditions do not matter.

Relationship between the scan electrode 102 (Y), the sustain electrode 103 (Z), and the barrier rib 112 in the inventive plasma display panel will be described with reference to FIG. 2 below.

Figure 2:
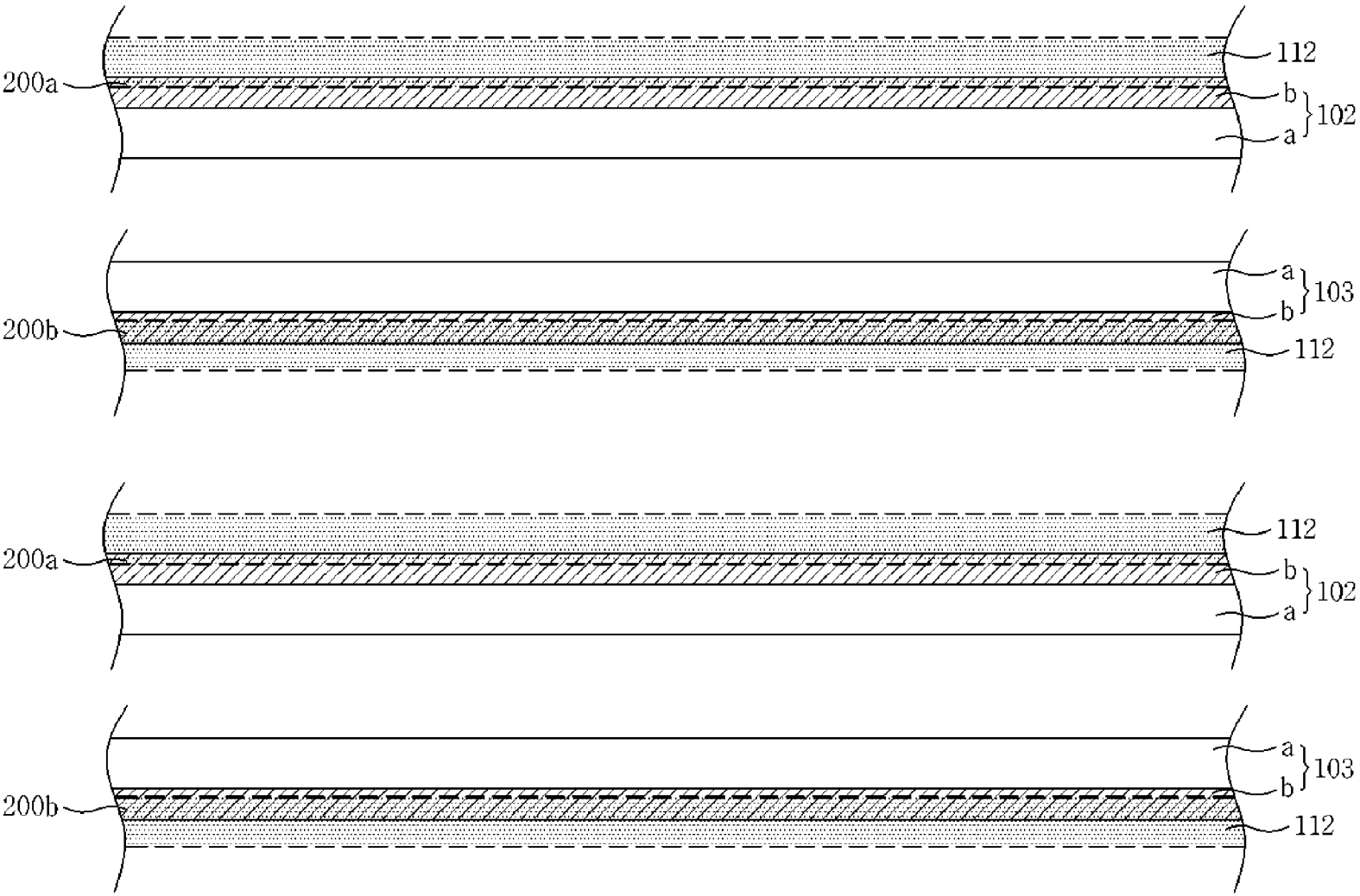
FIG. 2 illustrates detailed relationship of a scan electrode, a sustain electrode, and a barrier rib in a plasma display panel according to the present invention.

FIG. 2 illustrates detailed relationship of the scan electrode, the sustain electrode, and the barrier rib in the plasma display panel according to the present invention.

Referring to FIG. 2, an overlap portion 200*a* of the barrier rib 112 and the scan electrode 102 is different in area from an overlap portion 200*b* of the barrier rib 112 and the sustain electrode 103.

In FIG. 2, the scan electrode 102 and the sustain electrode 103 each comprise the transparent electrode (a) and the bus electrode (b), and the barrier rib 112 is disposed to be in parallel with the scan electrode 102 and the sustain electrode 103. Here, the portion 200*b* of the sustain electrode 103 hidden by the barrier rib 112 is wider in area than the portion 200*a* of the scan electrode 102 hidden by the barrier rib 112.

FIG. 2 illustrates only a format in which the barrier rib 112 is in parallel with the scan electrode 102 and the sustain electrode 103, but the barrier rib 112 can be also formed in direction of intersecting with the scan electrode 102 and the sustain electrode 103. However, for description convenience, FIG. 2 illustrates only the barrier rib 112 of the format parallel with the scan electrode 102 and the sustain electrode 103.

In order to more clarify the structure of the inventive plasma display panel, a sectional structure of the inventive plasma display panel will be described with reference to FIG. 3 below.

Figure 3:
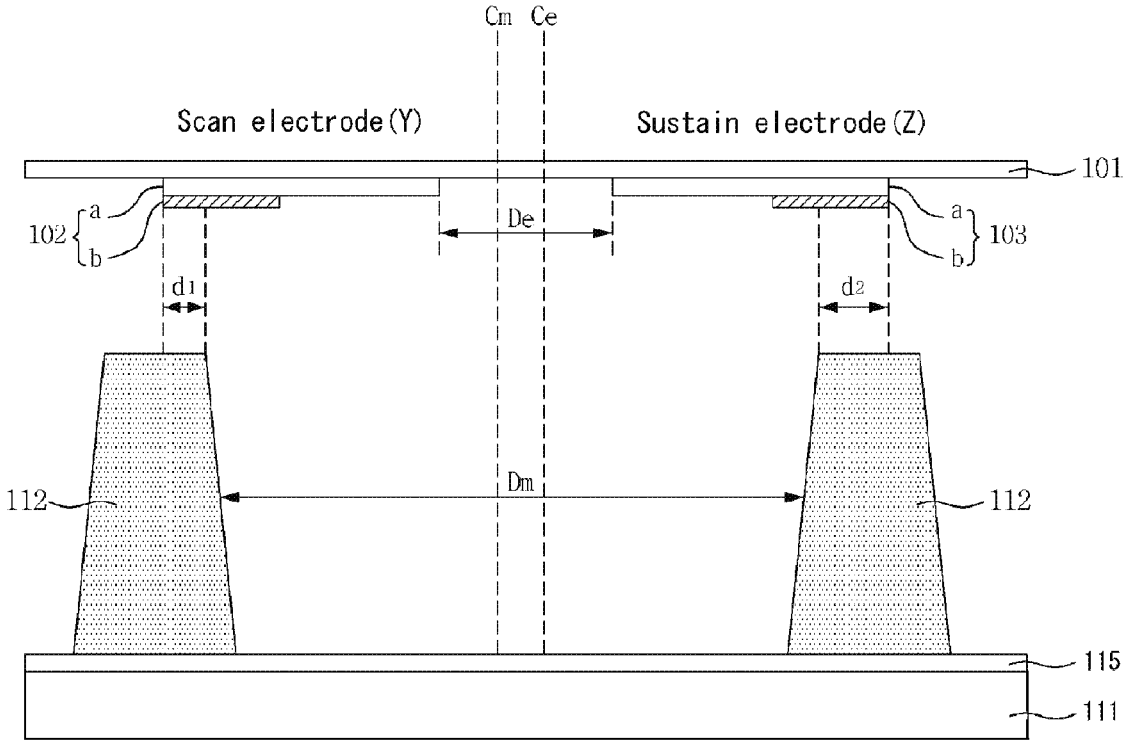
FIG. 3 illustrates a sectional structure of a plasma display panel according to the present invention.

FIG. 3 illustrates the sectional structure of the plasma display panel according to the present invention.

Referring to FIG. 3, shown is a structure in which the barrier rib 112 partitions the discharge cell between the front substrate 101 comprising the scan electrode 102 and the sustain electrode 103, and the rear substrate 111.

The scan electrode 102 and the barrier rib 112 are overlapped at a predetermined portion (d1), and the sustain electrode 103 and the barrier rib 112 are also overlapped at a predetermined portion (d2). The predetermined portion (d1) in which the scan electrode 102 and the barrier rib 112 are overlapped is set in width to be smaller than the predetermined portion (d2) in which the sustain electrode 103 and the barrier rib 112 are overlapped.

That is, as illustrated in FIG. 3, when the scan electrode 102 and the sustain electrode 103 have the same length, the overlap portion of the scan electrode 102 and the barrier rib 112 has a smaller width than the overlap portion of the sustain electrode 103 and the barrier rib 112.

Meantime, as described above, the present invention is characterized in that overlap regions between the respective electrodes and the barrier ribs connected with the electrodes are differently set. This is possible through more detailed arrangement of the electrode and the barrier rib at a predetermined position.

For example, as shown in FIG. 3, the scan electrode 102 and the sustain electrode 103 are arranged on the barrier rib 112 forming one discharge cell. In this case, the present invention is characterized in that a barrier rib center point (Cm) between a first barrier rib corresponding to the scan electrode and a second barrier rib corresponding to the sustain electrode 103 is different from an electrode center point (Ce) between the scan electrode 102 and the sustain electrode 103.

The barrier rib center point (Cm) can be obtained from interval between points corresponding to middle heights of the first and second barrier ribs. In other words, if the interval between the points is denoted by "Dm", the barrier rib center point (Cm) can be a point corresponding to Dm/2.

In the same manner, if a distance between the scan electrode 102 and the sustain electrode 103 is denoted by "De", the electrode center point (Ce) can be a point corresponding to De/2. The distance (De) between the electrodes can be defined as a distance between ends of the transparent electrode 102*a* of the scan electrode and the transparent electrode 103*a* of the sustain electrode. In the above description, the electrode center point (Ce) is defined on the basis of the distance between the ends of the transparent electrodes 102*a* and 103*a*, but the electrode center point (Ce) can be defined in the same manner using the bus electrode (b) and, in an ITO-less structure, the electrode center point (Ce) can be defined in the same manner using the bus electrode (b). In other words, effect of the present invention can be obtained by getting the center (Ce) of at least one of the bus electrode (b) and the transparent electrode (a) different from the barrier rib center point (Cm).

As described above, the present invention has arrangement such that the barrier rib center point (Cm) can be positioned at a different point from the electrode center point (Ce), thereby setting the overlap area of the sustain electrode 103 and the barrier rib 112 to be greater than the overlap area of the scan electrode 102 and the barrier rib 112.

As such, reason why the overlap area of the sustain electrode 103 and the barrier rib 112 gets to be greater than the overlap area of the scan electrode 102 and the barrier rib 112 is to stabilize the address discharge.

This will be described with reference to FIGS. 4A and 4B below.

Figure 4A:
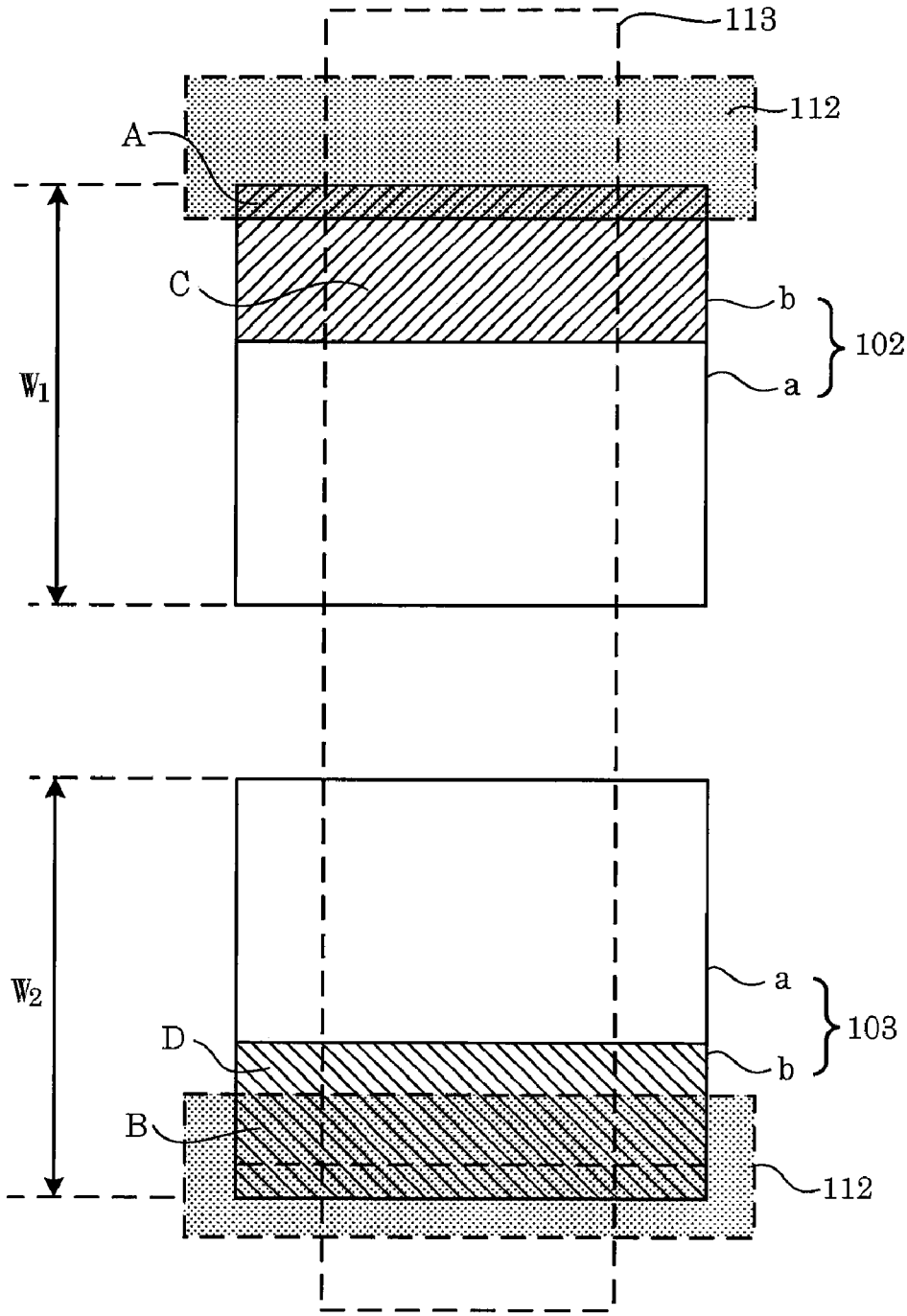
FIGS. 4A and 4B illustrate reason why an overlap area of a sustain electrode and a barrier rib is greater than an overlap area of a scan electrode and a barrier rib.
Figure 4B:
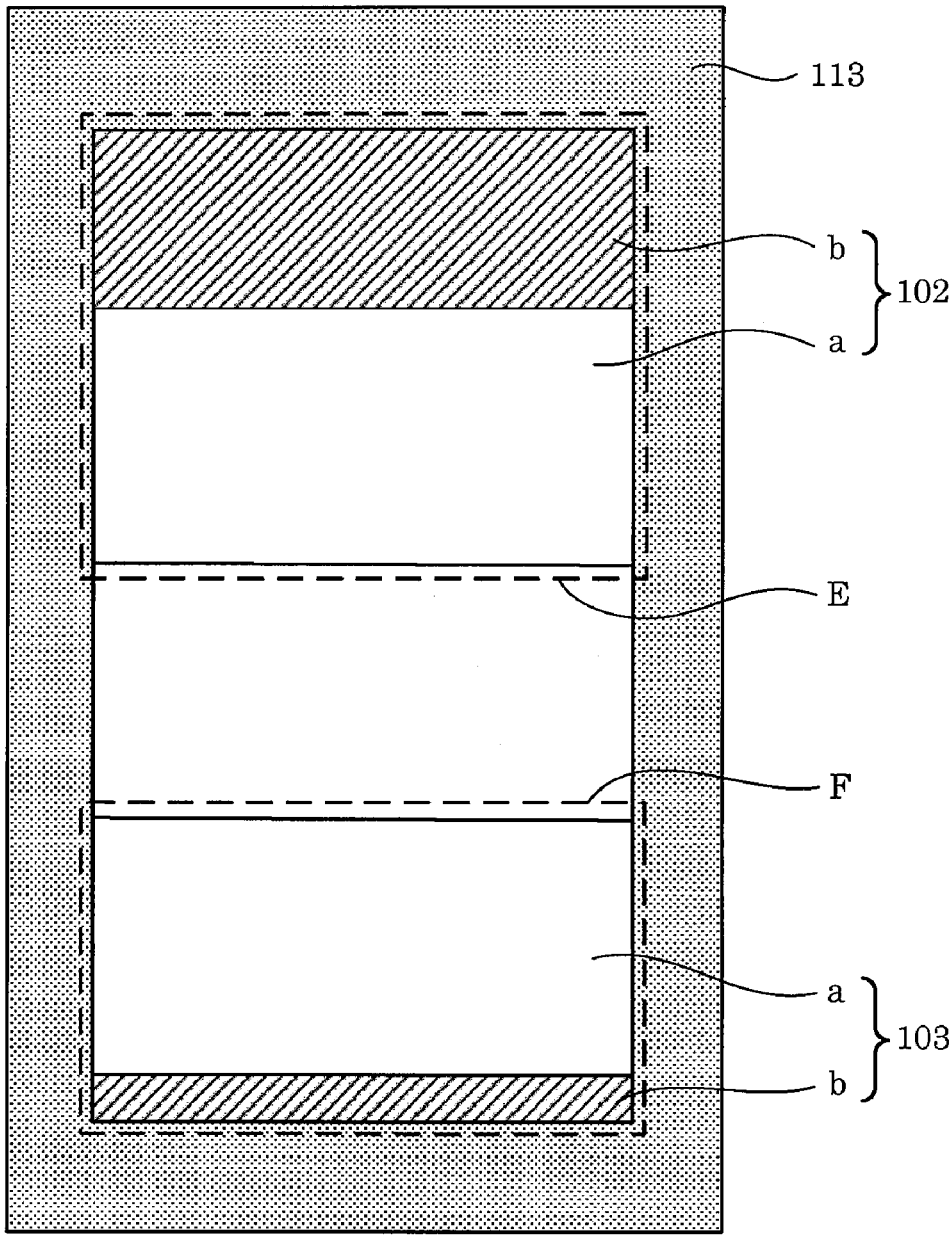

FIGS. 4A and 4B illustrate the reason why the overlap area of the sustain electrode and the barrier rib is greater than the overlap area of the scan electrode and the barrier rib.

First, referring to FIG. 4A, as the overlap area (B) of the sustain electrode 103 and the barrier rib 112 gets greater in width than the overlap area (A) of the scan electrode 102 and the barrier rib 112, an overlap area (C) of the scan electrode 102 and the address electrode 113 relatively gets greater in width than an overlap area (D) of the sustain electrode 103 and the address electrode 113 within one discharge cell. This structure is shown in FIG. 4B.

Referring to FIG. 4B, it can be appreciated that, as the overlap area (B) of the sustain electrode 103 and the barrier rib 112 gets greater in width than the overlap area (A) of the scan electrode 102 and the barrier rib 112 as shown in FIG. 4A, an area (E) of the scan electrode 102 is greater in width than an area (F) of the sustain electrode 103 within one discharge cell partitioned by the barrier rib 112.

Meantime, the address discharge for selecting the discharge cell in which sustain discharge is generated is generated between the scan electrode 102 and the address electrode 113. In more detail, if a scan pulse is supplied to the scan electrode 102, and a data pulse is supplied to the address electrode 113, a voltage difference between the scan pulse and the data pulse causes generation of the address discharge between the scan electrode 102 and the address electrode 113.

If the overlap area (C) of the scan electrode 102 and the address electrode 113 is relatively increased in width within one discharge cell, when the scan pulse and the data pulse for generating the address discharge are supplied, a relatively large amount of wall charges are generated on the scan electrode 102 and the address electrode 113.

If so, even though the scan pulse and the data pulse having the same voltage and pulse width as those of a conventional art are supplied, the relatively strong and stable address discharge in comparison with the conventional art is generated.

In a description based on another aspect, even when a width (W1) of the scan electrode 102 is the same as a width (W2) of the sustain electrode 103, if the front and rear substrates (not shown) are disposed to get the overlap area (B) of the sustain electrode 103 and the barrier rib 112 to be greater than the overlap area (A) of the scan electrode 102 and the barrier rib 112, even though the width (W1) of the scan electrode 102 is not varied greater than the width (W2) of the sustain electrode 103, the address discharge can be generated more strongly and stably.

Considering it, it is exemplary that the width (W1) of the scan electrode 102 and the width (W2) of the sustain electrode 103 are almost the same.

For another example, the overlap area (B) of the barrier rib 112 and the sustain electrode 103 is 110% to 200% of the overlap area (A) of the barrier 112 and the scan electrode 102. In other words, assuming that the overlap area (A) of the barrier rib 112 and the scan electrode 102 is 1000 $\mu m^2$, the overlap area (B) of the barrier rib 112 and the sustain electrode 103 is 1100 $\mu m^2$ to 2000 $\mu m^2$.

As such, reason why the overlap area (B) of the barrier rib 112 and the sustain electrode 103 is set to be 110% or more of the overlap area (A) of the barrier rib 112 and the scan electrode 102 is to provide sufficient strong and stable address discharge.

Further, the reason why the overlap area (B) of the barrier rib 112 and the sustain electrode 103 is set to be 200% or less of the overlap area (A) of the baffler rib 112 and the scan electrode 102 is that, if the width of the overlap area B of the barrier rib 112 and the sustain electrode 103 is excessively greater than the width of the overlap area (A) of the barrier rib 112 and the scan electrode 102 within one discharge cell in excess of 200%, then the discharge may become unstable at the time of discharge between the scan electrode 102 and the sustain electrode 103, such as, for example, at the time of the sustain discharge, as a result of the wall charges becoming excessively concentrated.

Figure 5:
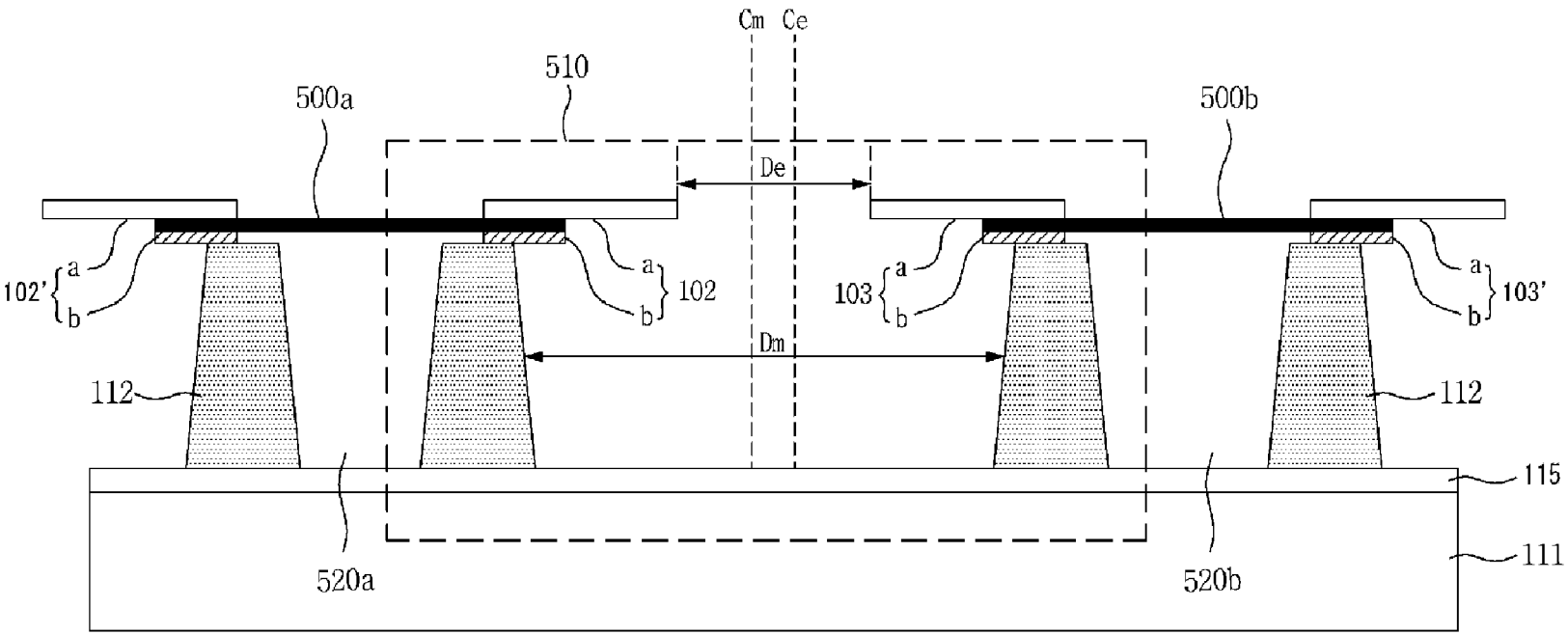
FIG. 5 illustrates a plasma display panel in which a channel is provided at a barrier rib.

Meanwhile, in order to increase discharge efficiency of the inventive plasma display panel, a channel having a predetermined width can be formed at a portion of the barrier rib. This will be described with reference to FIG. 5 below. As shown in FIG. 5, the channel perfectly separates two barrier ribs from each other, but in an embodiment of the present invention, there is provided a structure in which the two barrier ribs separated by the channel are connected at their bottoms with each other.

FIG. 5 illustrates the plasma display panel in which the channel is provided at the barrier rib.

Referring to FIG. 5, considering arrangement relationship between the scan electrode 102 and the sustain electrode 103, it can be confirmed that two scan electrodes 102 and two sustain electrodes 103 are adjacent with each other, respectively.

In other words, the inventive plasma display panel has an electrode arrangement structure having sequence of the scan electrode 102, a scan electrode 102', the sustain electrode 103, and a sustain electrode 103'.

Here, one discharge cell partitioned by the barrier rib 112 is denoted by a reference numeral 510.

Meantime, as described above, in the present invention, the interval between the electrodes or the barrier ribs is controlled to differently set the overlap regions of the respective electrodes and the barrier ribs connected to the electrodes.

As shown in FIG. 5, the scan electrode 102 and the sustain electrode 103 are arranged on the barrier rib constituting one discharge cell 510. In this case, the present invention is characterized in that the barrier rib center point (Cm) between the first barrier rib corresponding to the scan electrode and the second barrier rib corresponding to the sustain electrode 103 is different from the electrode center point (Ce) between the scan electrode 102 and the sustain electrode 103.

As shown in FIG. 3, the barrier rib center point (Cm) can be obtained from the interval between the points corresponding to the middle heights of the first and second barrier ribs. In other words, if the interval between the points is expressed by "Dm", the barrier rib center point (Cm) can be a point corresponding to Dm/2.

In the same manner as described in FIG. 3, if the distance between the scan electrode 102 and the sustain electrode 103 is expressed by "De", the electrode center point (Ce) can be a point corresponding to De/2. The distance (De) between the electrodes can be defined as the distance between the ends of the transparent electrode 102*a* of the scan electrode and the transparent electrode 103*a* of the sustain electrode.

As described above, in the present invention, the electrode center point (Ce) is defined on the basis of the distance between the ends of the transparent electrodes 102*a* and 103*a*, but the electrode center point (Ce) can be defined in the same manner using the bus electrode (b) and, in an ITO-less structure, the electrode center point (Ce) can be defined in the same manner using the bus electrode (b). In other words, effect of the present invention can be obtained by getting the center (Ce) of at least one of the bus electrode (b) and the transparent electrode (a) different from the barrier rib center point (Cm).

Accordingly, the present invention has arrangement such that the barrier rib center point (Cm) can be positioned at a different point from the electrode center point (Ce), thereby setting the overlap area of the sustain electrode 103 and the barrier rib 112 to be greater than the overlap area of the scan electrode 102 and the barrier rib 112.

Between two scan electrodes 102 and 102' adjacent with each other and between two sustain electrodes 103 and 103' adjacent with each other, channels 520*a* and 520*b* having predetermined widths are formed at the barrier ribs 112, lengthwise of the scan electrode and the sustain electrode, respectively.

In a detailed description, the channel 520*a* having the predetermined width is formed at the barrier rib 112 between the scan electrodes 102 and 102' adjacent with each other, and the channel 520*b* having the predetermined width (W2) is formed between the two sustain electrodes 103 and 103'.

As such, reason why the channel having the predetermined width is formed at the barrier rib 112 lengthwise of the scan electrode 102 and the sustain electrode 103 is to reduce total capacitance of the inventive plasma display panel, thereby increasing a discharge efficiency of the inventive plasma display panel.

Meanwhile, as described above, the scan electrode 102 and the sustain electrode 103 comprise the transparent electrode (a) and the bus electrode (b), respectively.

The transparent electrode (a) is formed of transparent metallic material, for example, indium-tin-oxide (ITO), and increases transmittance of visible light generated from the plasma display panel but has relatively low electrical conductivity, thereby decreasing the discharge efficiency.

In order to overcome a drawback of reducing the discharge efficiency, the bus electrode (b) is formed of material having relatively high electrical conductivity on the transparent electrode (a). For example, the bus electrode (b) is formed of silver (Ag).

However, since the bus electrode (b) is opaque and also has property of reflecting light, the light reflected from the bus electrode (b) is emitted to the exterior of the plasma display panel.

Since the reflection light causes reduction of the screen quality, a black color is further provided between the transparent electrode (a) and the bus electrode (b), thereby preventing emission of the reflection light.

Further, in the inventive plasma display panel, the mutually adjacent two scan electrodes 102 and 102' and sustain electrodes 103 and 103' commonly use one black layer, respectively.

For example, the mutually adjacent two scan electrodes 102 and 102' commonly use the black layer denoted by a reference numeral 500*a*, and the mutually adjacent two sustain electrodes 103 and 103' commonly use the black layer denoted by a reference numeral 500*b*.

In other words, the channels 520*a* and 520*b* provided between the mutually adjacent two scan electrodes 102 and 102' and between the mutually adjacent two sustain electrodes 103 and 103' comprise the same one black layers 500*a* and 500*b*, respectively.

If the black layers 500*a* and 500*b* are commonly used as described above, a manufacture process of the black layers 500*a* and 500*b* can be simplified. Further, the black layers 500*a* and 500*b* can not only prevent emission of the reflection light reflected from the bus electrodes (b) of the scan electrode 102 and the sustain electrode 103, but also the channels 520*a* and 520*b* provided between the barrier ribs 112 can be hidden, thereby improving a characteristic of contrast of the inventive plasma display panel. It should be noted that constituent elements and structures of the above black layers 500*a* and 500*b* are not intended to limit this embodiment of the present invention.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus comprising:

a first electrode and a second electrode formed on an upper substrate, wherein each of the first and second electrodes comprises a base electrode and a bus electrode formed on the base electrode;

a first barrier rib formed over a lower substrate disposed under the first electrode; and a second barrier rib formed over the lower substrate disposed under the second electrode, wherein a barrier rib center point between the first and second barrier ribs is different from an electrode center point between the first and second electrodes, wherein the first barrier rib overlaps with the bus electrode of the first electrode only in part and the second barrier rib overlaps with the bus electrode of the second electrode only in part.

2. The apparatus of claim 1, wherein the barrier rib center point is a point corresponding to half of an average distance between the first and second barrier ribs.

3. The apparatus of claim 1, wherein the electrode center point is a point corresponding to half of a distance between the first and second electrodes.

4. The apparatus of claim 1, wherein, within a discharge cell, an overlap area of the first barrier rib and the first electrode is less than an overlap area of the second barrier rib and the second electrode.

5. The apparatus of claim 1, wherein the width of the base electrode of first electrode is equal to the width of the base electrode of the second electrode.

6. The apparatus of claim 1, further comprising a third electrode formed on the upper substrate, wherein the first and third electrodes are scan electrodes adjacent to each other and forming different discharge cells.

7. The apparatus of claim 6, further comprising a third barrier rib formed over the lower substrate disposed under the third electrode, wherein a scan channel is formed between the first and third barrier ribs.

8. The apparatus of claim 7, wherein the scan channel comprises a black layer.

9. The apparatus of claim 1, further comprising a fourth electrode formed on the upper substrate, wherein the second and fourth electrodes are sustain electrodes adjacent to each other and forming different discharge cells.

10. The apparatus of claim 9, further comprising a fourth barrier rib formed over the lower substrate disposed under the fourth electrode wherein a sustain channel is formed between the second and fourth barrier ribs.

11. The apparatus of claim 1, wherein each of the base electrodes of the first electrode and the second electrode is a transparent electrode.

12. A plasma display panel comprising:

a first electrode and a second electrode formed on an upper substrate, wherein each of the first and second electrodes comprises a base electrode and a bus electrode formed on the base electrode;

a first barrier rib formed over a lower substrate disposed under the first electrode; and a second barrier rib formed over the lower substrate under the second electrode, wherein the first barrier rib overlaps with the bus electrode of the first electrode only in part and the second barrier rib overlaps with the bus electrode of the second electrode only in part, and wherein a width of an overlap area between the first barrier rib and the bus electrode of the first electrode is different from a width of an overlap area between the second barrier rib and the bus electrode of the second electrode.

13. The panel of claim 12, wherein the width of the overlap area between the second barrier rib and the bus electrode of the second electrode is between 110% and 200% of the width of the overlap area between the first barrier rib and the bus electrode of the first electrode.

14. The panel of claim 12, wherein each of the base electrode of the first and second electrodes comprises indium-tin-oxide (ITO).

15. The panel of claim 12, wherein the width of the base electrode of the first electrode is equal to the width of the base electrode of the second electrode.

16. The panel of claim 12, further comprising a third electrode formed on the upper substrate and a third barrier rib formed over the lower substrate disposed under the third electrode, wherein a scan channel is formed between the first barrier rib and the third barrier rib.

17. The panel of claim 12, further comprising a fourth electrode formed on the upper substrate and a fourth barrier rib formed over the lower substrate disposed under the fourth electrode, wherein a sustain channel is formed between the second barrier rib and the fourth barrier rib.

18. The panel of claim 16, wherein the scan channel comprises a black layer.

19. The panel of claim 17, wherein the sustain channel comprises a black layer.

20. A plasma display panel comprising:

a first electrode and a second electrode formed on an upper substrate, wherein each of the first and second electrodes comprises a base electrode and a bus electrode formed on the base electrode;

a first barrier rib formed over a lower substrate disposed under the first electrode;

a second barrier rib formed over the lower substrate disposed under the second electrode; and a discharge cell defined between the first barrier rib and the second barrier rib, wherein the first barrier rib overlaps with the bus electrode of the first electrode only in part and the second barrier rib overlaps with the bus electrode of the second electrode only in part, and wherein an overlap area of the discharge cell and the bus electrode of the first electrode is different in size from an overlap area of the discharge cell and the bus electrode of the second electrode.

* * * * *